United States Patent [19]

Hughes et al.

[11] Patent Number: 4,469,460

[45] Date of Patent: Sep. 4, 1984

[54] MATRIX PRINTER WITH OPTIMUM PRINTING VELOCITY

[75] Inventors: John J. Hughes, Round Rock; Darryl R. Polk, Austin, both of Tex.

[73] Assignee: International Business Machines Corporation, Armonk, N.Y.

[21] Appl. No.: 429,646

[22] Filed: Sep. 30, 1982

[51] Int. Cl.[3] ..... B41J 19/30

[52] U.S. Cl. ..... 400/322; 101/93.16; 400/124; 400/320

[58] Field of Search ..... 400/124, 320, 322, 279, 400/76, 323; 101/93.15, 93.16, 93.17; 364/152, 518

[56] References Cited

U.S. PATENT DOCUMENTS

| | | | |
|---|---|---|---|
| 3,496,547 | 2/1970 | Gorrill et al. | 400/279 X |
| 3,582,897 | 6/1971 | Marsh, Jr. | 101/93.14 X |
| 3,739,350 | 6/1973 | Moran | 364/900 |
| 3,761,880 | 9/1973 | Kritz et al. | 364/900 |
| 3,764,994 | 10/1973 | Brooks et al. | 400/124 X |
| 3,938,641 | 2/1976 | Fulton | 400/124 X |
| 3,973,662 | 8/1976 | Fulton | 400/124 |
| 3,986,091 | 10/1976 | Quiogue et al. | 400/322 X |
| 4,007,449 | 2/1977 | Vercesi | 364/200 |
| 4,179,223 | 12/1979 | Kwan et al. | 400/279 X |
| 4,405,245 | 9/1983 | Fukushima | 400/322 X |

*Primary Examiner*—Paul T. Sewell

*Attorney, Agent, or Firm*—J. B. Kraft

[57] ABSTRACT

A serial printer is provided which moves the printhead at optimum velocity with respect to the document being printed so as to achieve maximum throughput. Prior to the printing of each line of alphanumeric characters, the printer contains means for determining the length of said line. In response to said determined line length, drive means move the printhead across the medium at a selected velocity which is based upon the determined line length. The present expedient is particularly applicable to matrix printers wherein the selected velocity is constant during the actual printing of the line.

8 Claims, 4 Drawing Figures

MATRIX PRINTER WITH OPTIMUM PRINTING VELOCITY

DESCRIPTION

Background of Invention

The present invention relates to printers and particularly to serial printers which have the capability of operating at variable velocities.

Background Art

With the expansion of word processing systems throughout the office systems industry, there has been an increasing demand for printers which provide letter quality documents at very high throughput rates, e.g., in the order of 100 to 400 net characters per second. Because of the high throughput requirement, matrix printers have been viewed with increasing favor over the more traditional printwheel or ball types of printers. In the matrix printer, as the printhead is indexed from print position to print position, characters are formed by the selective energization of elements in a matrix or line in a printhead to provide the selected visual pattern forming the character. The formation of characters on the matrix type of printhead is customarily faster than the positioning of the selected characters on the printwheel or ball types of printheads because in the matrix printhead, the selection process is entirely electronic while on the printwheel or ball type of printer, the selection is a slower mechanical one. An additional advantage of the matrix type of printer is that the selection time at each print position is uniform while in the printwheel or ball type of printer, the selection time will vary based upon the time required to traverse the distance from the last selected character to the next one which of course will be variable based upon the character positions. As a result, in matrix type printers, the whole print line may be printed at a constant carrier escapement velocity while in the ball or printwheel printers, the escapement velocities of the carrier have to be varied throughout each print line in order to maximize throughput. Otherwise, the escapement velocity would be limited to that of the slowest possible character selection increment.

In view of this background, it is customary to operate matrix printers at much higher carrier velocities than ball or printwheel printers. However, since each line of print commences and ends with a stop position, the time required for the acceleration of matrix printer escapement from the initial stop position to selected printing velocity and the corresponding deceleration from the printing velocity to the terminal stop at the end of the print line may involve a significant portion of the time involved in printing an entire line.

As will be hereinafter described in greater detail, we have found that this acceleration and deceleration and consequently the time for printing an entire line may be substantially reduced by selecting carrier escapement velocities which are dependent upon the length of the line to be printed. For example, if the line to be printed is a relatively short one, it may very well be inefficient to spend the acceleration and deceleration time required to print at a maximum velocity. Since the characters to be printed in the line are few, it may be advantageous to "trade-off" maximum carrier velocity for relatively short acceleration and deceleration times.

U.S. Pat. No. 3,761,880, Kritz et al appears to represent the closest prior art. It discloses a variable speed matrix type of printer. Control means in the Kritz et al printer appear to control the printing velocity in order to operate the printer as close as possible to synchronization with the input being applied to the printer from a data processing system. Kritz et al do not wish to operate their printer at such a high speed that a printer prints the data faster than it is received since this would cause unnecessary stoppage and slow down the printer equipment and consequently the overall operation. In order to achieve this synchronization between their printer and the data processor input, Kritz et al utilize an input buffer in which the data being input from the data processing system is loaded. Then, dependent on the amount of the data backlog in the buffer, the printer is operated at selected velocities. If the buffer is very heavily loaded, the printer operates at a faster pace. As the buffer becomes unloaded, the printing operation slows down. In this manner, the printer need never run out of information and be required to stop. However, in Kritz et al there is no suggestion of making the printing velocity for each line dependent upon the length of said line.

Disclosure of the Present Invention

The present invention provides a matrix printer having a printhead suitably mounted on a carrier movable across a record medium such as paper document to be printed upon. The printer is characterized by having means for determining the length of the next line of alphanumeric characters to be printed by said printhead on said medium in combination with drive means which are responsive to the determined length for moving the printhead across the medium at a selected velocity based upon this determined length. In addition, means are provided for activating the printhead during this movement of the printhead to print the particular line of characters. The present invention is most advantageously utilized in matrix printheads and particularly where the printer is a wire matrix printer. In the case of matrix printers, the selected velocity is constant during the actual printing of the line.

In accordance with a more specific embodiment of the present invention, means for determining the line length of the next line to be printed includes storage means for receiving and storing input data representative of the alphanumeric characters forming the next printed line in combination with means for scanning the stored data and determining the length of the printed line of the next line to be printed from this data.

BRIEF DESCRIPTION OF THE DRAWINGS

Referring now to the drawings, wherein a preferred embodiment of the invention is illustrated, and wherein like reference numerals are used throughout to designate like parts.

BEST MODE FOR CARRYING OUT THE INVENTION

Figure 1:
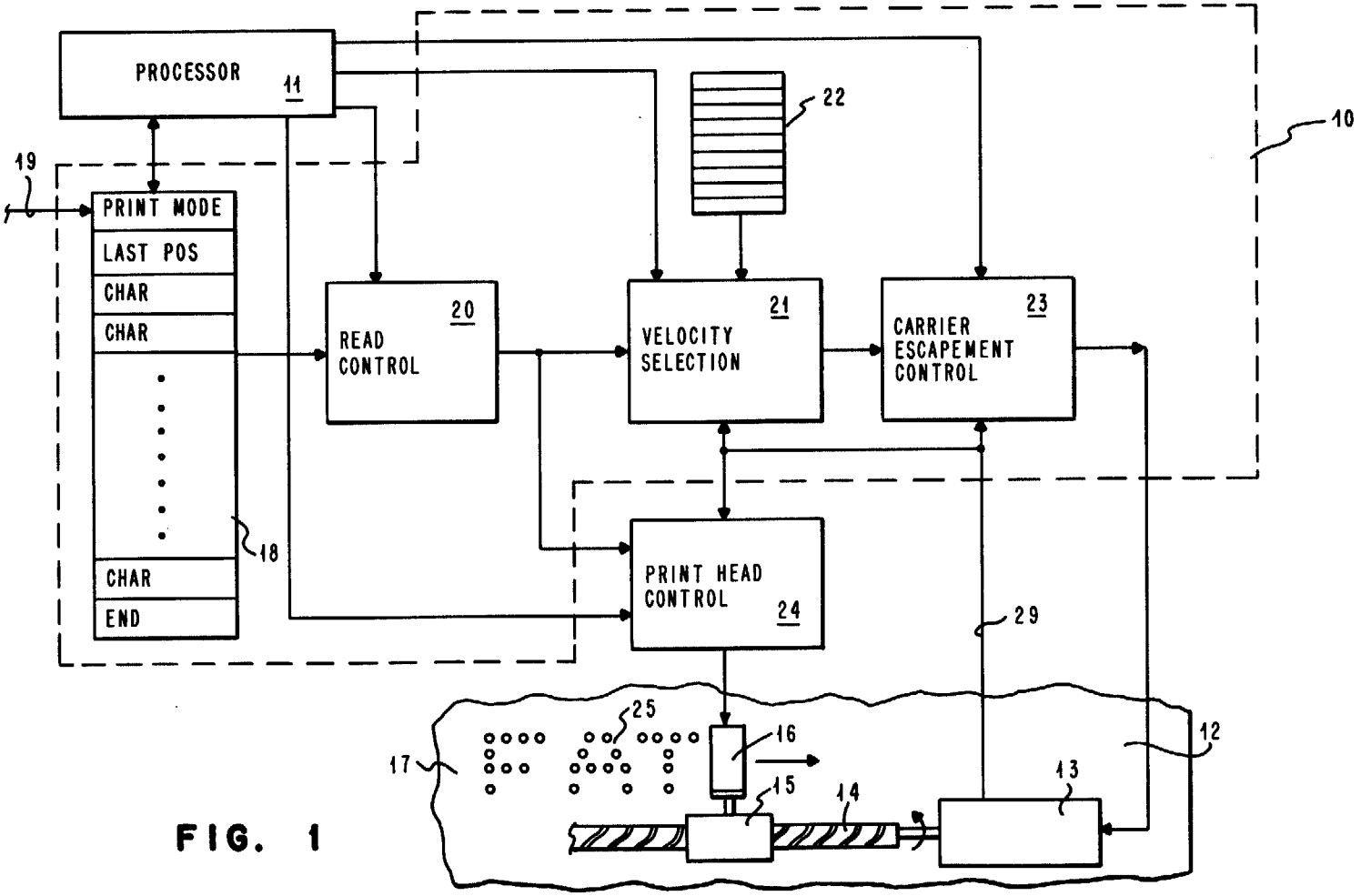
FIG. 1 is a diagrammatic representation of the logic in the printer control system which may be used to carry out the velocity selection expedient of the present invention.

Now with reference to FIGS. 1 and 2, the velocity selection system of the present invention will be described in detail. First, with reference to FIG. 1, velocity selection logic unit 10 is part of the control system of a printer which is under the control of a processor 11 which may be any conventional microprocessor used for this purpose such as the Intel 8085. Logic unit 10 controls the escapement velocity of a printer 12 which comprises a stepper motor 13 rotating a lead screw escapement 14 to move carrier 15 supporting printhead 16 along a line of the document 17 being printed. Printhead 16 may be any conventional matrix printhead of the type described in U.S. Pat. No. 3,764,994 for purposes of the present example.

The data to be printed is loaded one line at a time into print line buffer 18 from input line 19 coming from any standard data processor or text processing host CPU to which the printer is attached. Under the guidance of processor 11, read control unit 20 serially reads out the characters to be printed in a given print line from buffer 18. Read control unit 20 also can read the end of print line position in buffer 18 of the particular line of print currently being stored in the buffer. Velocity selection unit 21 also under the control processor 11 will make the appropriate velocity selection from velocity table 22 based upon the line length as will be described in greater detail hereinafter with respect to the flow chart of FIG. 2. Carrier escapement control unit 23 will control the carrier escapement velocity through stepper motor 13 based upon the velocity selection, and printhead control unit 24 will selectively activate particular elements of the matrix in head 16 to produce the character provided from read control unit 20 at a position based upon that of velocity selection unit 21 whereby the printed characters 25 are correct in format and printed at the correct position along the line being printed in document 17.

Now, using the logic ang apparatus described above with respect to FIG. 1, the operations involved in the present invention will be described with respect to the flow chart in FIG. 2. First, decision block 26, a determination is made as to whether there is a new line in print line buffer 18. This determination is made in the velocity selection unit 21 based upon data read from line buffer 18 by read control unit. If there is a new line in the buffer, then, block 27, the last character position in that new line is accessed. This is accomplished through read control unit 20. Then, block 28, the line length is calculated or determined in velocity selection unit 21. The line length is determined by subtracting the last character position from the current character position. This current character position has been stored in velocity selection unit 21 which keeps track of the carrier position through feedback via line 29 from the conventional position sensing device associated with stepper motor 13.

Next, the print mode is accessed, block 30. The print mode or pitch of the characters is stored in line buffer 18 and accessed through read control unit 20 to velocity selection unit 21. Then, block 31, the print velocity is selected through velocity lookup table 22 by velocity selection unit 21. Selection in table 22 is based upon two parameters, i.e., line length and print mode. As will be hereinafter described in greater detail, the velocities listed in table 22 are selected so as to provide the maximum throughput considering the length of the line and the pitch of the characters. The selected velocity will be a fixed one, i.e., once actual printing begins after acceleration to the fixed printing velocity and before deceleration to the stopped position at the end of the line.

Next, block 32, the print distance is determined, i.e., distance over which the actual printing is done. This determination is carried out in the velocity selection unit and is based upon print mode, i.e., character pitch, and the difference between the present and last character position. Next, the selected velocity and the print distance is transferred from the velocity selection unit to the carrier escapement control, as set forth in block 34. Then, under the combined control of carrier escapement control unit 23 and printhead control unit 24, both under the control of processor 11, stepper motor 13 is appropriately rotated moving escapement lead screw 14 and thus carrier 15 over the distance to be printed while printhead 16 produces the selected characters in the conventional manner. Upon the completion of the printing, the process is returned to decision block 26.

Upon the return to decision block 26, the procedure is repeated. Let us assume that on a given iteration through decision block 26, a determination is made that there is no new line in the buffer. Then, decision block 35, a determination is made as to whether or not the carrier is at the last character position. If the carrier is at the last character position, then, the carrier is stopped, block 36, and the current carrier position, i.e., the stopped location is stored, as set forth in block 37. This information is stored in the velocity selection unit 21 to be used for the next determination of line length. On the other hand, if a determination is made in decision block 35 that the carrier is not at the last position, then, the system is returned directly to decision block 26 for determination as to whether a new line is now in the buffer.

Figure 3:
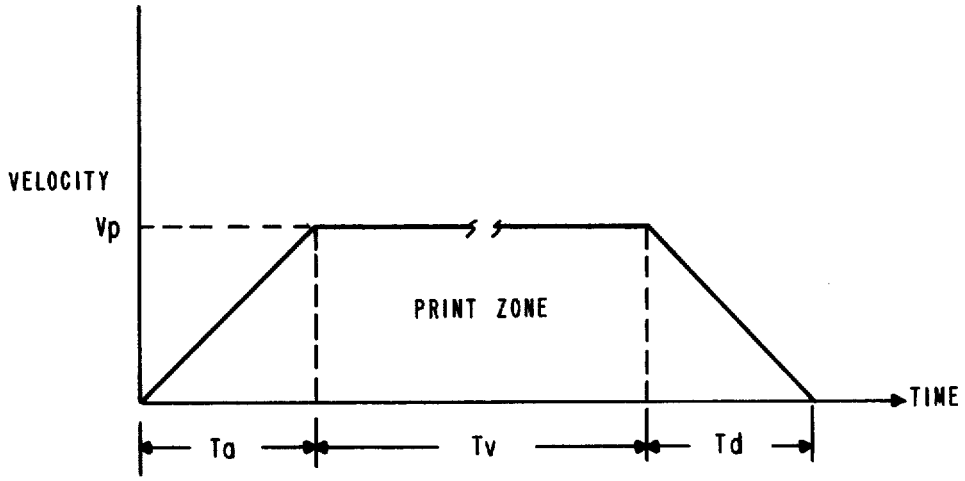
FIG. 3 is a timing graph illustrating the change in velocity with time during the printing of a typical line.

We have hereinabove discussed in general the advantages of selecting the velocity at which the characters are to be printed based upon the length of the lines to be printed. Now with respect to FIGS. 3 and 4, we will explain the theory involved in our approach as well as how some specific calculations of optimum velocity may be made. With reference to FIG. 3, $V_p$ = Print velocity $T_a$ = Acceleration time to print velocity = $V_p/a$ a = Acceleration capability of carrier drive mechanism $T_v$ = Time required to print the line of text at at the selected velocity =

$$\frac{\text{Line Length}}{V_p} = \frac{L}{V_p}$$

$T_d$ = Deceleration time required to stop carrier = $V_p/a$.

If the acceleration rate is assumed equal to the deceleration rate, the equation for the total print time is as follows:

$$T = \frac{2V_p}{a} + \frac{L}{V_p} \tag{1}$$

If throughput is defined as the number of characters printed per unit of time, the equation relating throughput, line length, and velocity is as follows:

$$\text{Throughput (net characters per second)} = N = \frac{LP}{T} \quad (2)$$

Where
L=length of line
P=Density of characters on line
T=Time to print the line from Equation (1)
Inserting (1) into (2) yields:

$$N = \frac{aV_pLP}{2V_p^2 + aL} \quad (3)$$

The rate of change of the throughput is obtained by taking the first derivative of (3) with respect to the print velocity parameter, $V_p$:

$$\frac{dN}{dV_p} = \frac{aLP(aL - 2V_p^2)}{(2V_p^2 + aL)^2} \quad (4)$$

Figure 4:
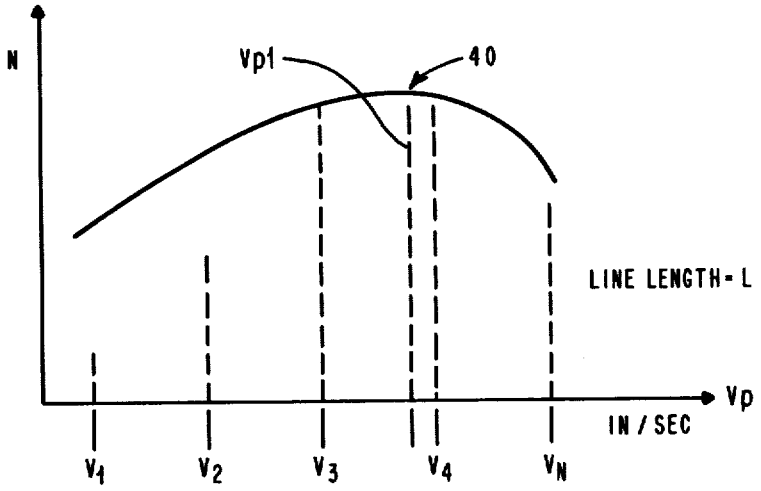
FIG. 4 is a graph showing the change in N, net printing throughput in characters per second for a print line for a given print line length and acceleration/deceleration with different printing velocities.

FIG. 4 illustrates a graphical representation of the N vs $V_p$ curve for a given line length and acceleration value.

The point 40 on the N vs $V_p$ curve where the derivative goes to zero dictates the choice of earlier velocity which yield the maximum throughput. This value can be obtained by setting the derivative (4) to zero and solving for $V_p$.

$$\frac{dN}{dV_p} = 0 = aL - 2V_p^2$$

$$V_p = (aL/2)^{\frac{1}{2}}$$

Figure 2:
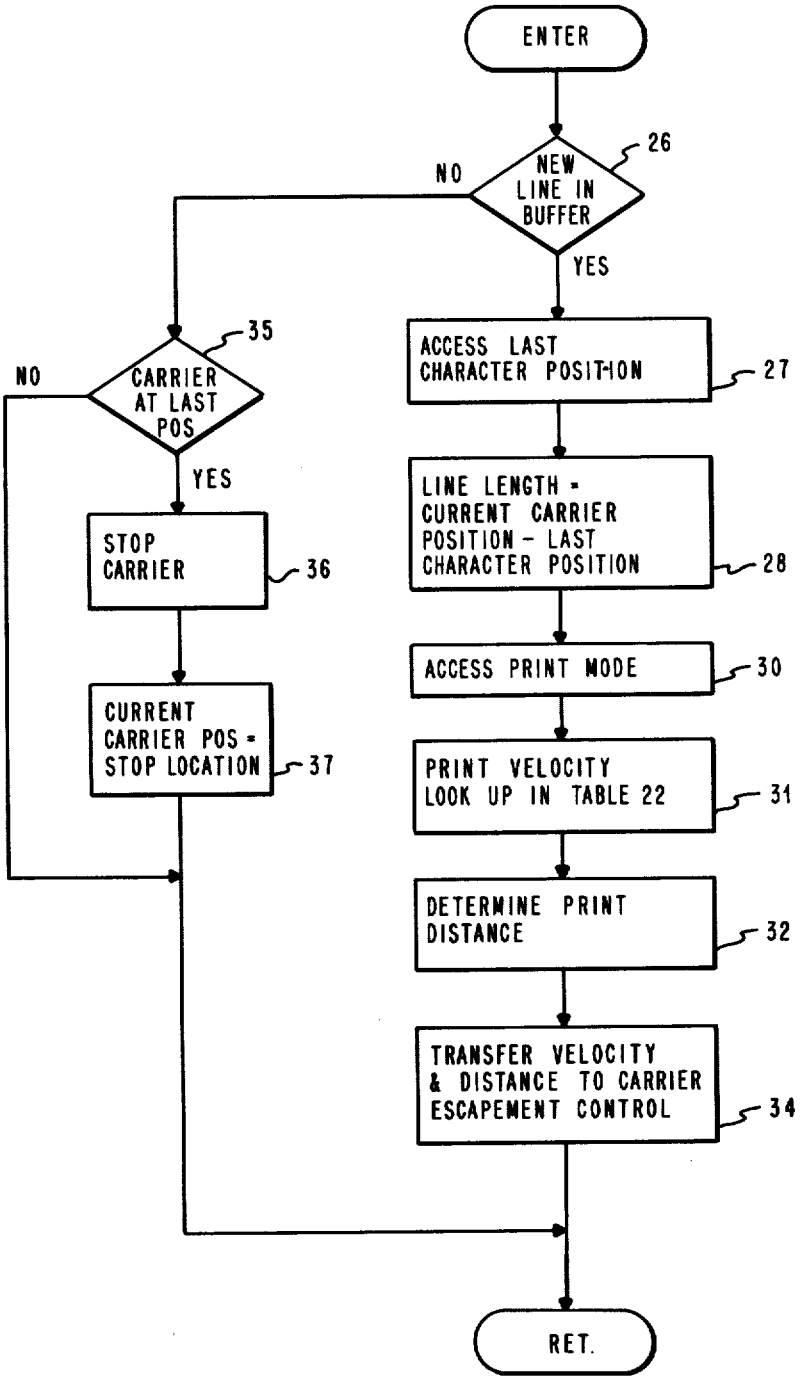
FIG. 2 is a flow chart of the process carried out in the control system in making a velocity selection.

The above calculations are made for a series of line values in advance and stored in velocity table 22 of FIG. 1. It should be noted that for a particular line length the optimum velocity, i.e., point 40 on the curve of FIG. 4 designated $V_{p1}$ may be a velocity which is not one of the velocities available on the printer. For purposes of the illustration in FIG. 4, velocities available on the printer are designated as $V_1$, $V_2$, $V_3$, and $V_4$. In such a case, the velocity designated in the table 22 for the line length would be the velocity closest to the optimum velocity. In this case, it would be velocity $V_4$. Thus, for best results the selected velocity is such that $$T_{ad} = T_v,$$

wherein
$T_{ad}$ is the total time which it takes the printhead to accelerate to the selected velocity and to decelerate from said velocity, and
$T_v$ is the total printing time at said constant velocity.
However, when the optimum constant velocity is above the maximum constant velocity at which the printer can mechanically print, then the final selected velocity should be such that $$T_{ad} < T_v,$$

where
$T_{ad}$ is the total time which it takes the printhead to accelerate to the selected velocity and to decelerate from said velocity, and
$T_v$ is the total printing time at said constant velocity.

While the invention has been particularly shown and described with reference to a preferred embodiment it will be understood by those skilled in the art that various other changes in form and detail may be made without departing from the spirit and scope of the invention.

We claim:

1. A printer comprising
a printhead movable across a record medium,
means for determining the length of a line of alphanumeric characters to be printed by said printhead on said medium,
drive means responsive to said determined length for moving said printhead across said medium at a selected uniform velocity said velocity being different for different line lengths, and
means for activating said printhead during the movement of said printhead to print said line of characters.

2. The printer of claim 1 wherein said selected velocity is constant during the printing of said line.

3. The printer of claim 2 wherein the selected velocity is such that $$T_{ad} = T_v,$$

wherein
$T_{ad}$ is the total time which it takes the printhead to accelerate to the selected velocity and to decelerate from said velocity, and
$T_v$ is the total printing time at said constant velocity.

4. The printer of claim 2 wherein the selected velocity is such that $$T_{ad} < T_v,$$

where
$T_{ad}$ is the total time which it takes the printhead to accelerate to the selected velocity and to decelerate from said velocity, and
$T_v$ is the total printing time at said constant velocity, and
said constant velocity is the maximum velocity at which said printhead can be moved.

5. The printer of claim 1 wherein said printhead is a matrix printhead.

6. The printer of claim 5 wherein said matrix printhead is a wire matrix printhead.

7. A printer comprising
a printhead movable across a record medium,
storage means for receiving and storing input data representative of alphanumeric characters forming a printed line,
means for scanning said stored data and determining the length of said printed line,
drive means responsive to said line length determination for moving said printhead across said medium at a selected uniform velocity said velocity being different for different line lengths, and
means for activating said printhead during said movement of said printhead to print said line of characters.

8. The printer of claim 7 wherein said printhead is a wire matrix printhead.

* * * * *